US007699683B2

(12) United States Patent
Caspi

(10) Patent No.: US 7,699,683 B2
(45) Date of Patent: Apr. 20, 2010

(54) REMOTE CONTROL PAINTBALL GUN

(75) Inventor: Yuval Caspi, Granada Hills, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 850 days.

(21) Appl. No.: 11/425,360

(22) Filed: Jun. 20, 2006

(65) Prior Publication Data

US 2007/0039602 A1 Feb. 22, 2007

Related U.S. Application Data

(60) Provisional application No. 60/692,759, filed on Jun. 22, 2005.

(51) Int. Cl.
*A63H 30/04* (2006.01)

(52) U.S. Cl. ..... 446/456; 124/71

(58) Field of Classification Search ..... 124/71–77; 446/154, 454–456; 180/167
See application file for complete search history.

(56) References Cited

U.S. PATENT DOCUMENTS

| | | | | | |
|---|---|---|---|---|---|
| 3,132,442 | A * | 5/1964 | Barr | 446/31 |
| 4,226,292 | A * | 10/1980 | Monte et al. | 180/6.5 |
| 4,993,912 | A * | 2/1991 | King et al. | 414/729 |
| 5,016,004 | A * | 5/1991 | Funk et al. | 340/825.69 |
| 5,100,153 | A * | 3/1992 | Welte | 273/357 |
| 5,123,327 | A * | 6/1992 | Alston et al. | 89/1.813 |
| 5,263,396 | A * | 11/1993 | Ladan et al. | 89/1.11 |
| 5,295,890 | A * | 3/1994 | Myers | 446/176 |
| 5,842,907 | A * | 12/1998 | Niimura et al. | 446/435 |
| 6,237,462 | B1 * | 5/2001 | Hawkes et al. | 89/41.05 |
| 6,408,731 | B1 * | 6/2002 | Elsener | 86/50 |
| 6,491,253 | B1 * | 12/2002 | McIngvale | 244/3.11 |
| 6,679,158 | B1 * | 1/2004 | Hawkes et al. | 89/41.05 |
| 7,458,371 | B2 * | 12/2008 | Ong et al. | 124/65 |
| 2004/0050240 | A1 * | 3/2004 | Greene et al. | 89/41.06 |
| 2006/0178085 | A1 * | 8/2006 | Sotereanos et al. | 446/456 |
| 2007/0119296 | A1 * | 5/2007 | Niv et al. | 89/37.02 |
| 2008/0063400 | A1 * | 3/2008 | Hudson et al. | 398/106 |
| 2008/0115660 | A1 * | 5/2008 | Hensel | 89/136 |

* cited by examiner

*Primary Examiner*—Troy Chambers
(74) *Attorney, Agent, or Firm*—Intellectual Property Law Offices of Joel Voelzke, APC

(57) ABSTRACT

A remote control paintball gun system is disclosed which may include a hopper for containing paintballs of different densities, a paint ball gun barrel associated for receiving paintballs, a motorized, wheeled chassis, a cartridge mounted along a side of the gun barrel for powering the gun barrel and a remote control for controlling motion, transfer of the paint balls from the hopper to the gun barrel, and firing of a paintball. The remote control may include a control for selectively transferring a paintball in accordance with the paintball's density, from the first or second plurality of paintballs, to the gun barrel and may control elevation of the gun barrel. A method of playing paintball may include players who carry and fire hand held paintball guns to hit other players and one or more self propelled paintball gun for remote control operation.

8 Claims, 8 Drawing Sheets

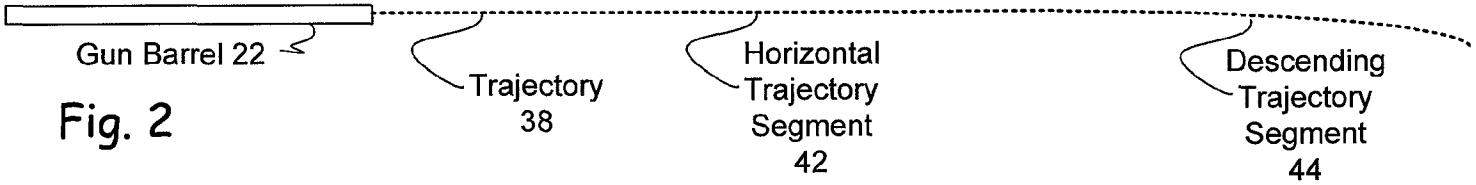
Fig. 2
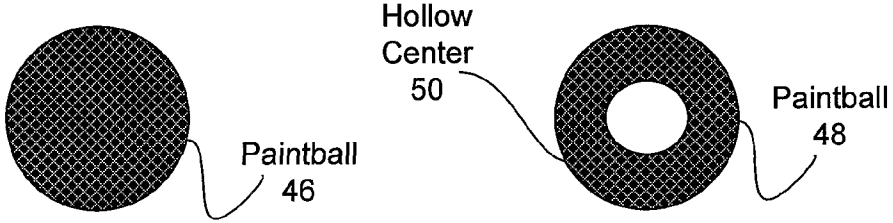
Fig. 3
Fig. 4
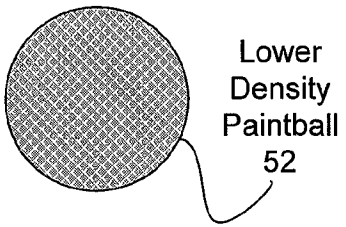
Fig. 5
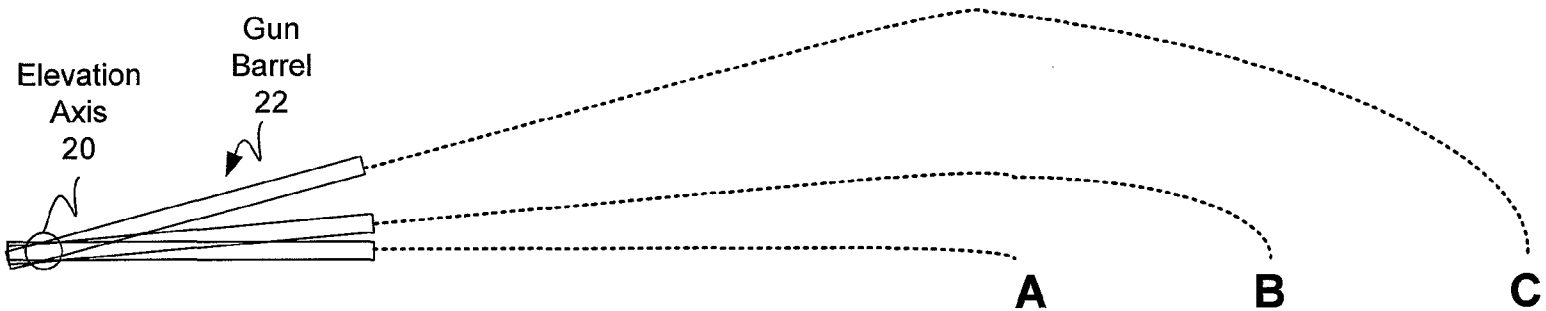
Fig. 6

REMOTE CONTROL PAINTBALL GUN

RELATED APPLICATIONS

This patent application claims the priority of U.S. provisional patent application Ser. No. 60/692,759 filed on Jun. 22, 2005.

BACKGROUND OF THE INVENTION

1. Field of the Invention

This invention is related to paintball equipment and methods of play and, in particular, to remotely controlled, self propelled paintball guns and related game play.

2. Description of the Prior Art

Paintball is conventionally played with hand held guns, powered by $CO_2$, which fire spherical ammunition that splatters when it strikes another player to indicate a hit.

What is needed are improvements in game play and equipment.

BRIEF DESCRIPTION OF THE DRAWINGS

FIG. 2 is a schematic representation of the trajectory of a projective from a paintball gun barrel held approximated horizontally.

FIG. 3 is a cross sectional view of a first type of paintball projectile having a first density, weight and mass.

FIG. 4 is a cross sectional view of a second type of paintball projectile having a second density, weight and mass, lower than the paintball shown in FIG. 3.

FIG. 5 is a cross sectional view of a third type of paintball projectile having a third density, weight and mass, even lower than the paintball shown in FIG. 2.

FIG. 6 is a schematic representation of the trajectories of projectiles from a paintball gun barrel held several different angles of elevation.

SUMMARY OF THE INVENTION

Figure 1:
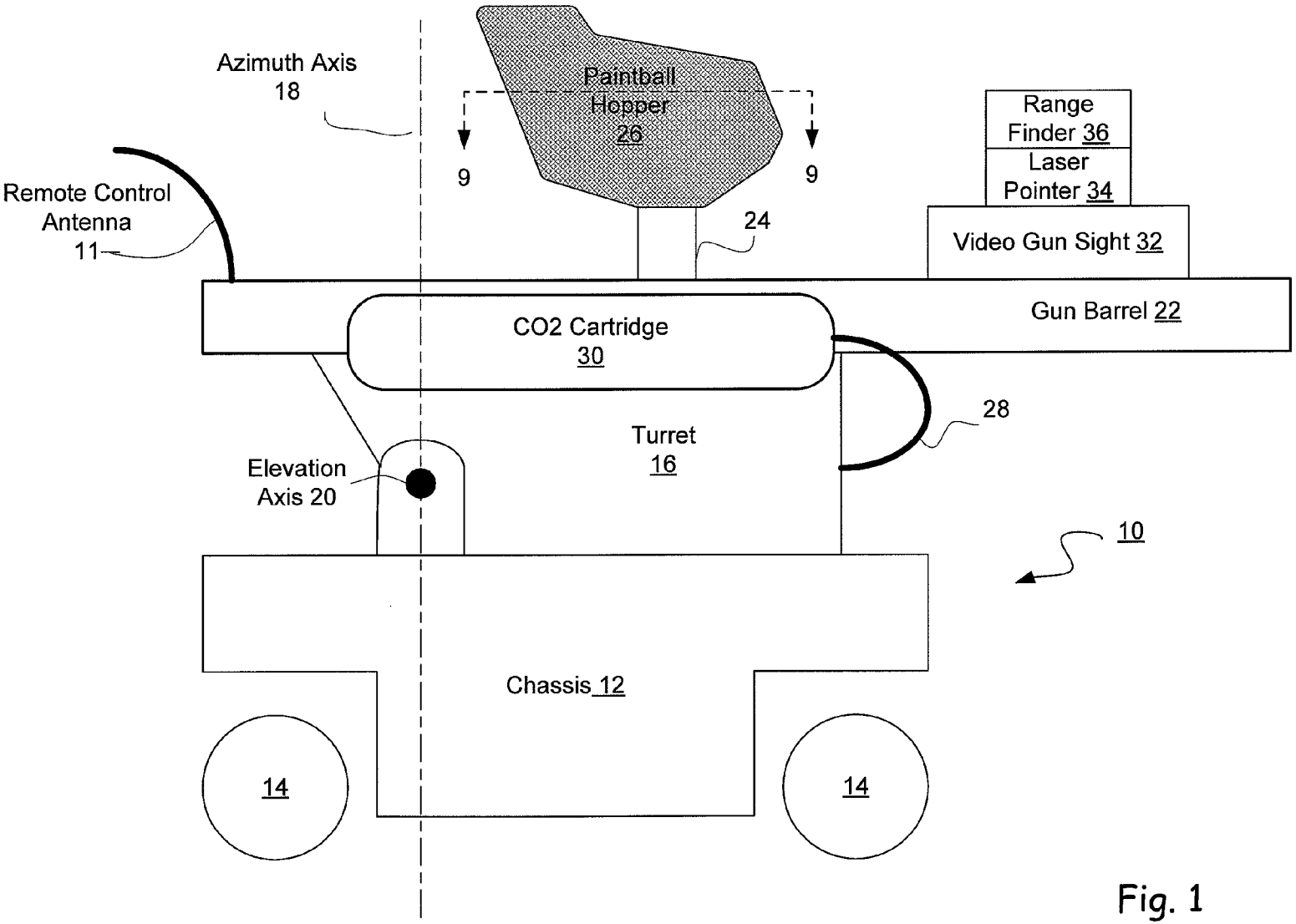
FIG. 1 is a side view of a stylized remote control, self propelled paintball gun.

A remote control paintball gun system is disclosed which may include a hopper for containing paintballs, a paint ball gun barrel associated with the hopper for receiving paintballs, a motorized, wheeled chassis for supporting the gun barrel and the hopper, a cartridge mounted along a side of the gun barrel for powering the gun barrel, and a remote control for controlling motion of the chassis, transfer of one of the paint balls from the hopper to the gun barrel, and firing of a paintball from the paintball gun barrel. The hopper may include a first compartment for containing a first plurality of paintballs having a first density and a second compartment for containing a second plurality of paintballs having a different density. The remote control may include a control for selectively transferring a paintball in accordance with the paintball's density, from the first or second plurality of paintballs, to the gun barrel and may control elevation of the gun barrel.

The remote control may also include a user operable range control for selecting a range of fire of the paintball gun, the range control determining both the elevation of the gun barrel and the selection of the paintball to be transferred to the gun barrel from the first or second compartment in accordance with the selected range. A turret supporting the gun barrel may be mounted on the chassis for elevation rotation about a first axis and azimuthal rotation about a second axis crossing the first axis at right angles. The remote control may also include a target display calibrated to show an expected point of contact with a target based on the density of the paintball to be fed from the hopper to the gun barrel. The target display may also display expected points of contact with the target for paintballs having different densities and indicate an elevation of the gun barrel required to achieve the expected point of contact so that the user can determine if a shot fired at that elevation would likely be obstructed.

A method of playing a paintball game is disclosed which may include identifying a playing field within which a plurality of players may carry and fire hand held paintball guns and providing a self propelled paintball gun for remote control operation in the playing field. An operator of the remote controlled paintball gun maybe able to view the players in the playing field directly or may only be able to view the players in the playing field on a display associated with the remote control for the self propelled paintball gun.

The game play may also include selecting paintballs having a first and a different density for feeding to the remote controlled paintball gun and/or selecting an elevation of a barrel of the paintball gun in accordance the selected density of the paintball fed to the gun and a range from the gun to a displayed target. A user may operate a range control for selecting a desired range for target which automatically selects the density of the paintball to be fed to paintball gun and the elevation of the gun barrel.

DETAILED DISCLOSURE OF THE PREFERRED EMBODIMENT(S)

Referring now to FIG. 1, self propelled paintball gun 10 includes chassis 12 mounted on wheels 14, two of which are visible in this side view. Wheels 14 may be powered individually, in pairs along the side of the vehicle and/or a pair of front or rear wheels may be turned to steer gun 10. Turret 16 is mounted on chassis 12 and preferably is mounted for azimuth rotation about axis 18. Turret 16 is preferably also mounted for elevation rotation about axis 20 which may intersect axis 18 at right angles. Paintball gun barrel 22 is preferably mounted for azimuth and elevation rotation with turret 16 or may be separately mounted for rotation about azimuth axis 18 and elevation axis 20 if turret 16 is not mounted for rotation with respect to chassis 12. Gun 10 includes antenna 11 so that operation of gun 10 may by controlled remotely, for example, by remote control 74 described in greater detail below with reference to FIG. 11.

Ammunition in the form of one or more types of paintballs is supplied to gun barrel 22 via pipe 24 from paintball hopper 26. Power is supplied to gun barrel 22 via flexible pipe 28 from $CO_2$ cartridge 30. In a preferred embodiment, cartridge 30 is mounted along side gun barrel 22, parallel and generally co-planar or slightly lower toward the ground as shown in FIG. 1. The side by side placement of the gun barrel and cartridge, using a flexible coupling there between, substantially reduces the overall length of the gun barrel and therefore of the entire self propelled paintball gun 10. The reduction in length results in greater maneuverability.

In a preferred embodiment, video gun sight 32 may be mounted on gun 10 for the operator. The video display may be incorporated in the remote control housing as described in greater detail below with regard to FIGS. 7-10. Video gun sight 32 may be mounted for motion with turret 16 or gun barrel 22 so that the elevation and/or azimuth of gun sight 32 tracks gun barrel 22. Alternately, video gun sight 32 may be mounted for motion directly with chassis 12 so that azimuth and elevation of the video display track gun 10 without regard to motion of gun barrel 22. If gun 10 is provided with gun barrel elevation without turret rotation, video gun sight 32 may be mounted to gun barrel 22 for elevation while the orientation of chassis 12 provides azimuth.

Similarly, laser pointer 34 may also be mounted on gun barrel 22, turret 16 or chassis 12. Laser pointer 34 is preferably mounted on gun barrel 12 and projects a laser spot visible on the target. The spot project by laser pointer 34 may also be shown as laser spot 40 on a video display as discussed in more detail below with regard to FIGS. 8-10. In addition, in some configurations, range finder 36 may also be mounted on gun barrel 22, turret 16 or chassis 12 and preferably on gun barrel 22 as an aid in projecting paintballs to accurately hit targets.

Referring now to FIG. 2, gun barrel 22 may be used in a zero elevation or horizontal position to project a paintball using $CO_2$ as a propellant. As shown by trajectory 38, the paintball projectile will travel a certain distance in horizontal flight, horizontal trajectory segment 42, and eventually the projectile will begin to fall to earth as shown by descending trajectory segment 44. As known for other projectiles and guns, a target within the range of horizontal trajectory segment 42 may be hit by firing directly at the target. A target aimed within the range of descending trajectory segment 44 may be hit only by aiming above it.

Conventional paintball games and equipment are designed to be hand held and elevation adjustments are rarely if ever used even though the range of a paintball gun is intentionally quite limited. Lobbing a shot off to a target too distant to hit may be counterproductive because it may simply serve to notify the target of the shooter's presence. The use of self propelled paintball gun 10 in a paintball game changes the play substantially, separating the projectile weapon from the shooter. Gun 10 is a substantially smaller target than a person and therefore harder to hit and easier to hide after a shot is fired. Such differences may substantially change the desirability of lobbing shots off at high angles with lower likelihood of hitting a target, compared to hand held projectile weapons.

Referring now to FIG. 3, as noted above, paintball guns are intentionally range limited for safety reasons and to generally contain the play with a particular area. The use of $CO_2$ as a propellant, and a relatively light weight projectile of powder and paint, further limits the range of conventional paintball guns. Paintball 46 is intended to represent a conventional paintball which is typically a compressed spherical mass of powder held together tightly enough to be projected but lightly enough to break apart on impact without injury to the target. The mass (or weight) and dimensions of the spherical paint ball control the length of horizontal trajectory segment 42, that is, the range of furthest target that can be struck by aiming directly at it. For any particular paintball, the dimensions of the spherical paintball are dictated by the internal dimensions of the gun barrel, such as barrel 22, and cannot easily be changed.

Although paintballs are typically considered too light for accurate long distance shots, and therefore paintball players would often like to use a heavier paintball for greater accuracy, the range at which targets can accurately be hit may be extended by decreasing the weight or mass of the paintball and/or controllably lobbing the paintball at an elevated angle.

Referring now to FIG. 4, hollow paintball is shown as one example of a paintball of relatively reduced mass. By incorporating hollow center 50 within an otherwise conventional paintball as shown in FIG. 3, the weight of paintball 48 may be substantially reduced. There is a limit on the size of the hollow center that can be used to reduce weight or mass, however, because of the inherent fragility of conventional paintballs. The incorporation of larger and larger hollow centers effectively reduces the wall thickness of paintball 48. Eventually, the fragility of the resultant structure will render it unusable as a projectile because it will disintegrate or fail while stored, loaded into hopper 26, fired out of gun barrel 22 by propellant from $CO_2$ cartridge 30 or during flight.

Referring now to FIG. 5, lower density paintball 52, made of a lower density version of the same material used in paintball 46 or of a different combination of materials, may also be used to lower the mass or weight of the paintball.

Referring now to FIG. 6, a series of elevation angles for gun barrel 22 are shown, together with the resultant trajectories of the projectile to specific targets. For comparison, target A is reached by a paintball fired from barrel 22 held at a zero elevation or horizontal position. The range from barrel 22 to target A is the typical maximum range at which paintballs are fired from handheld guns. The range from barrel 22 to target B is substantially longer and is achieved by elevating gun barrel 22 around axis 20 by a small amount, such as an angle of 5° as shown in the figure. The range from barrel 22 to target C is still longer and is achieved by further elevating gun barrel 22 to a greater angle, such as an angle of 15° as shown in the figure.

Raising the elevation of a hand held gun is easily performed accurately with practice. Accurately raising the elevation of a remote controlled gun may be more difficult to master.

Figure 7:
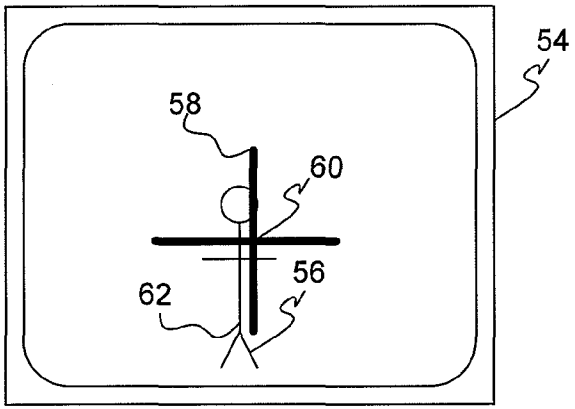

Referring now to FIG. 7, monitor 54 may be mounted as a video display on a remote control device for paint ball gun 10 and driven by video gun sight 32 shown in FIG. 1 to display a target shown as target 56. Video gun sight 32 may be mounted to gun barrel 22 of turret 16 to show a view of target 56 as seen along the axis of gun barrel 22. If gun barrel 22 is aimed at the left shoulder of target 56, the aim of gun barrel 22 may be displayed as a set of crosshairs 58 superimposed on video display 54. If gun barrel 22 is not elevated, that is, if gun barrel 22 is in a generally horizontal position, paintball 43 of FIG. 3 fired by gun 10 would strike target 56 where indicated at impact point 60.

At this elevation, the trajectory of paintball projectile is similar to that shown striking target A in FIG. 6. However, if target 56 is further away from gun 10 beyond the horizontal elevation range of paintball 46 for example in the position of target B, paintball 46 would strike target 56 at a lower impact point, such as at impact point 62 in the area of the left hip.

Figure 8:
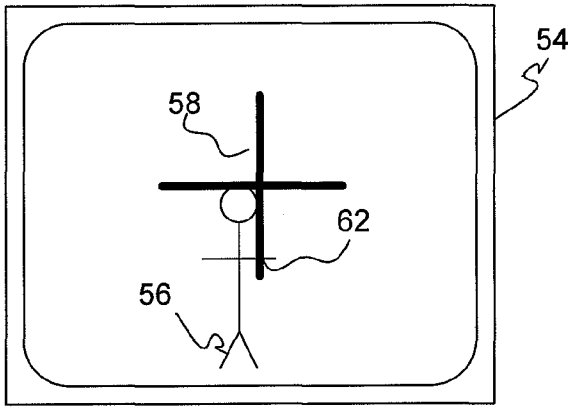
FIGS. 7-10 are front views of a display screen that may be associated with the aiming system of the paintball gun of FIG. 1.

Referring now also to FIG. 8, one way to correct the aiming of gun 10 for a target at the distance of targets B or C is to elevate gun barrel 22 to move the display of crosshairs 58 to a higher apparent position, such as a head shot. Although this result may be acceptable under some circumstances, motivating the user of gun 10 to always aim high for example by aiming for a head shot, is not a desirable practice.

A preferred alternative is to use a lower mass projectile, such as paintball 48 having a hollow center as shown in FIG. 4 or paintball 52 having fabricated from a lower density material as shown in FIG. 5, so that the range of a projectile fired at a horizontal trajectory includes targets at greater distances such as the ranges to targets B or C as shown in FIG. 5. In other words, in order to impact targets beyond the horizontal trajectory range of paintball 43 without necessarily changing the elevation of gun barrel 22, lower mass paintballs such as paintballs 48 or 52 (depending on the range to the target) may be used in order to strike target 56 at the impact point 60 indicated by crosshairs 58.

Figure 9:
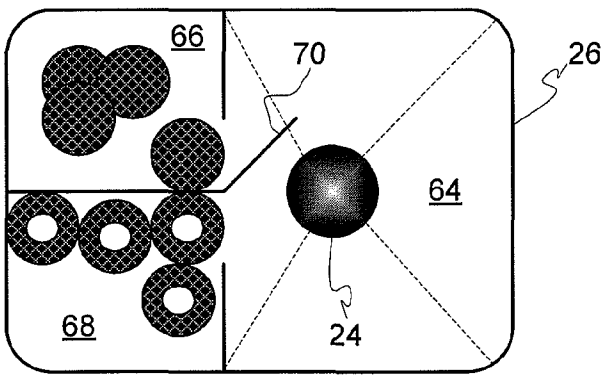

Referring now to FIG. 9, a top sectional view of paintball hopper 26 is shown, taken along line 9-9, as shown in FIG. 1. Hopper 26 may be divided into multiple compartments, such as loading compartment 64 which includes the top of loading pipe 24 at the lowest point in the compartment, compartment 66 which may contain standard weight paintballs and compartment 68 which may contain lower density paintballs. Openings from compartments 66 and 68 to loading compartment 64 may be controlled by one or more gates, shutters or pivoted flappers, shown generally as gate 70. Gate 70 may be operated manually, remotely and/or automatically, for example under the control of range finder 36 shown in FIG. 1, in order to allow a paintball with the appropriate mass or density to enter loading pipe 24 in compartment 64 so that the desired impact point on a target may be hit.

Figure 10:
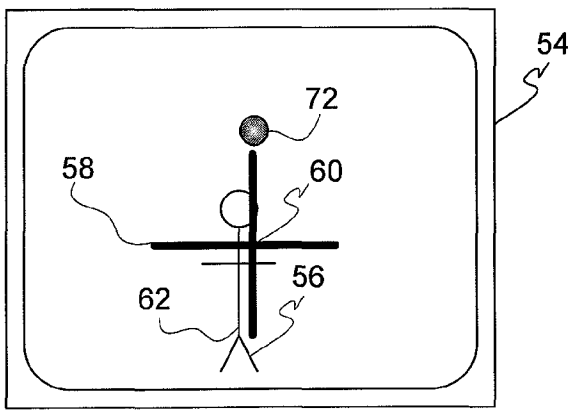

Referring now to FIG. 10, laser point 34 may also be mounted on gun barrel 22 as shown in FIG. 1 to paint a laser sighting spot, such as spot 72, wherever barrel 22 is aimed. Using a standard weight projectile such as paintball 43 to hit target 56 beyond the horizontal trajectory of the projectile at impact point 60, barrel 22 must be elevated as shown for example with regard to targets B and C as shown in FIG. 6. Laser spot 72 indicates the elevation of barrel 22 while crosshairs 58 may be adjusted to indicate the expected impact point 60 at the target. The position of crosshairs 58 may be adjusted manually, remotely and/or automatically in accordance with the range to target 56 determined for example by range finder 36.

Figure 11:
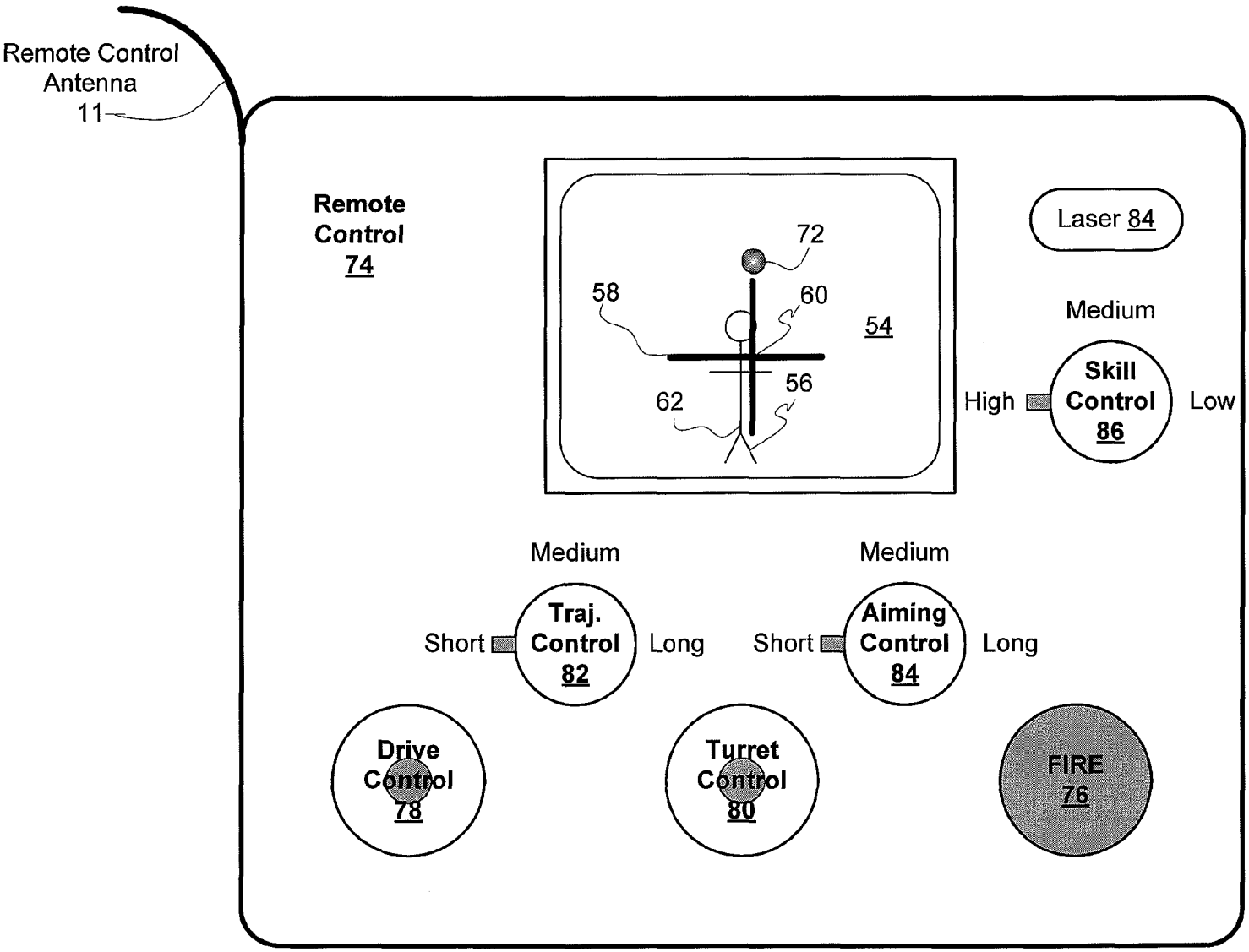
FIG. 11 is a top view of a remote control with video display that may be used to operate the remote control, self propelled paintball gun shown in FIG. 1.

Referring now to FIG. 11, hand held remote control 74 may include video display 54 for displaying target 56 and related target information to the user, such as range from range finder 36. Remote control antenna 11 may be used for communicating with paintball gun 10, for example by use of a series of remote control operating switches, buttons and joysticks. In particular, button 76 may be used to fire gun 10 and may preferably be operated by the user's thumb. Joystick 78 may be operated by the user to drive gun 10 forward and back and to steer left and right. Joystick 78 may preferably be operated by the user's other thumb so that the user may control gun 10 to fire while maneuvering. Joystick 80 may be operated by the user to provide turret control. Pulling back on joystick 80 may elevate gun barrel 22 around elevation axis 20, pushing joystick 80 forward may be used to decrease the elevation of barrel 22 around axis 20 in order to aim barrel 22 and/or change the effective range of gun 10. Pushing joystick 80 left or right may be used to swivel turret 16 left or right around azimuth axis 18 in order to aim gun barrel 22.

Remote control 74 may include range or trajectory control switch 82 to control the effective range of gun 10. For simplicity of description, range control switch 82 may be considered to have only three range settings, short, medium and long. However, range settings may be provided based on actual distances, perhaps as measured by range finder 36. Range control setting 82 may be used to manually or automatically select paintballs of different weights or densities, so that for example, selection of a short range shot may result in the loading of a standard weight projectile such as paintball 43 from hopper 26 via loading pipe 24 into a firing position in gun barrel 22, while selection of the medium and long range settings may result in the loading of higher or lower weight projectiles such as paintballs 50 and 52 respectively which may have greater horizontal trajectory segments 42 as noted above with respect to FIG. 2.

Alternately, range control 82 may be used to select the elevation of gun barrel 22 so that selection of short range may control elevation of gun barrel 22 to be in a horizontal position while selection of medium and long range may increase the elevation of gun barrel 22 by appropriate angles. Preferably, selection of particular ranges by operation of range control 82 will provide only additional elevation changes relative to the elevation of barrel 22 selected by turret control 80. For example, if a particular elevation of gun barrel 22 is selected by operation of turret control 80 as part of the aiming process, selection of a short range by operation of range control 82 would add no further elevation to gun barrel 22 while selection of a medium or long range would add an appropriate increase in elevation to gun barrel 22 in addition to the elevation of the barrel resulting from operation of turret control 80 as part of the aiming process.

Alternately, operation of aiming control 84 may be used to reposition crosshairs 58 to compensate for the range of the shot. If short range aiming control of gun 10 is selected by operation of aiming control 84, both crosshairs 58 and laser spot 74, if used, would be collocated along gun barrel 22 because the projectile would be expected to follow a substantially horizontal trajectory to the target. If however medium or long range was selected by aiming control 84, crosshairs 58 could be programmed to automatically be elevated to the point at which barrel 22 should be aimed. Using the targeting display illustrated in display 54, crosshairs 58 and laser spot 72 would normally be collocated at the point on target 56 that would be impacted if the projectile followed a horizontal path, for example, at desired impact point 60.

If, however, target 56 is at a distance greater than can be reached by a horizontal shot, crosshairs 58 could be automatically moved to a higher elevation, such as above the target's head where laser spot 72 is currently positioned, so that the shot trajectory was appropriate to hit target 56. This divergence of position between crosshairs 58 and laser spot 72 could serve as an indication to the operator that additional barrel elevation was required and any obstructions at the elevation should be considered. The additional elevation could be entered automatically, or by the operator, to move laser spot 72 from intended impact point 70 to be collocated with crosshairs 58 above the head of target 56. Thereafter, perhaps for confirmation that aiming was completed and firing permitted, crosshairs 58 could be made to snap back to its position at intended impact point 60.

In actual operation in a paintball game, gun 10 maybe used at several different levels of complexity and sophistication. In its simplest implementation, the gun operator would maneuver gun 10 into a position in which the projectile would likely hit the target based on the operator's direct view of the target, without reference to or use of display 54, laser spot 72, crosshairs 58, range finder 36, trajectory or aiming controls 82 and 84, and perhaps even without azimuth rotation of turret 16. This implementation could be called implementation or skill level 1.

In skill level 2, the operator may use azimuth rotation of turret 16. In skill level 3, laser spot 72 is generated and its image displayed. In skill level 4, crosshairs 58 may be used. In skill level 5, trajectory control 82 may be used to select different ranges and different weight projectiles and/or provide an added elevation to the aiming elevation selected by operation of turret control 80. In skill level 6, aiming control 84 may be used to select an appropriate elevation for gun barrel 22.

Many different combinations of levels of aim aiding may be provided. The operator may select a particular level by preference or by the exigencies of the game play. At times, run and shoot may be appropriate while at other times carefully aimed shots may be more appropriate. At times, multiple weights of projectiles may be available while at other times some weights of projectiles may not be available, perhaps because they have all been used. In such situations, it may be desirable to use one of more of the other elevation related modes so that the operator may take the most likely shots on target available at that time.

The various skill or aim aiding levels may also be keyed to the game play so that, in playing a particular paintball game the time or number of shots permitted in any particular mode may be limited. Alternately, handicapping may be provided based on operator skill and/or enemy fire. For example, detectors may be provided so that if gun 10 is impacted by a paintball projectile, predictable or unpredictable damage to the gun may be simulated by cessation of operation of certain functions. Rules may be selected for a particular game so that if a gun is hit once, display 54 or perhaps azimuth rotation of turret 16 by operation of turret control 80 may be inhibited completely or at least for a predetermined length of time.

In addition, an impact by a paintball projectile from an opponent's gun on the forward or viewing sight of video gun sight 32 may significantly reduce the usefulness of display 54 of remote control 74 regardless of skill or aiming levels or other operational game rules applied to remote control 74. Similarly, impacts of paintballs on range finder 36 or laser pointer 34 may have similar effects on the operation of gun 10 by remote control 74.

During a paintball game, in addition to conventional players using conventional handheld, hand-aimed paintball projectile guns, operators may control paintball gun 10 via remote control 74 exclusively or by participating as conventional players. Although a player participating exclusively by operation of remote control 74 may not have all the mobility and other aspects of game play, the use of remote control 74 may permit people to play paintball who might otherwise be unable play. For example, people in wheelchairs or otherwise injured participants of previous paintball games can easily play a paintball game from the sidelines using remote control 74.

Figure 12:
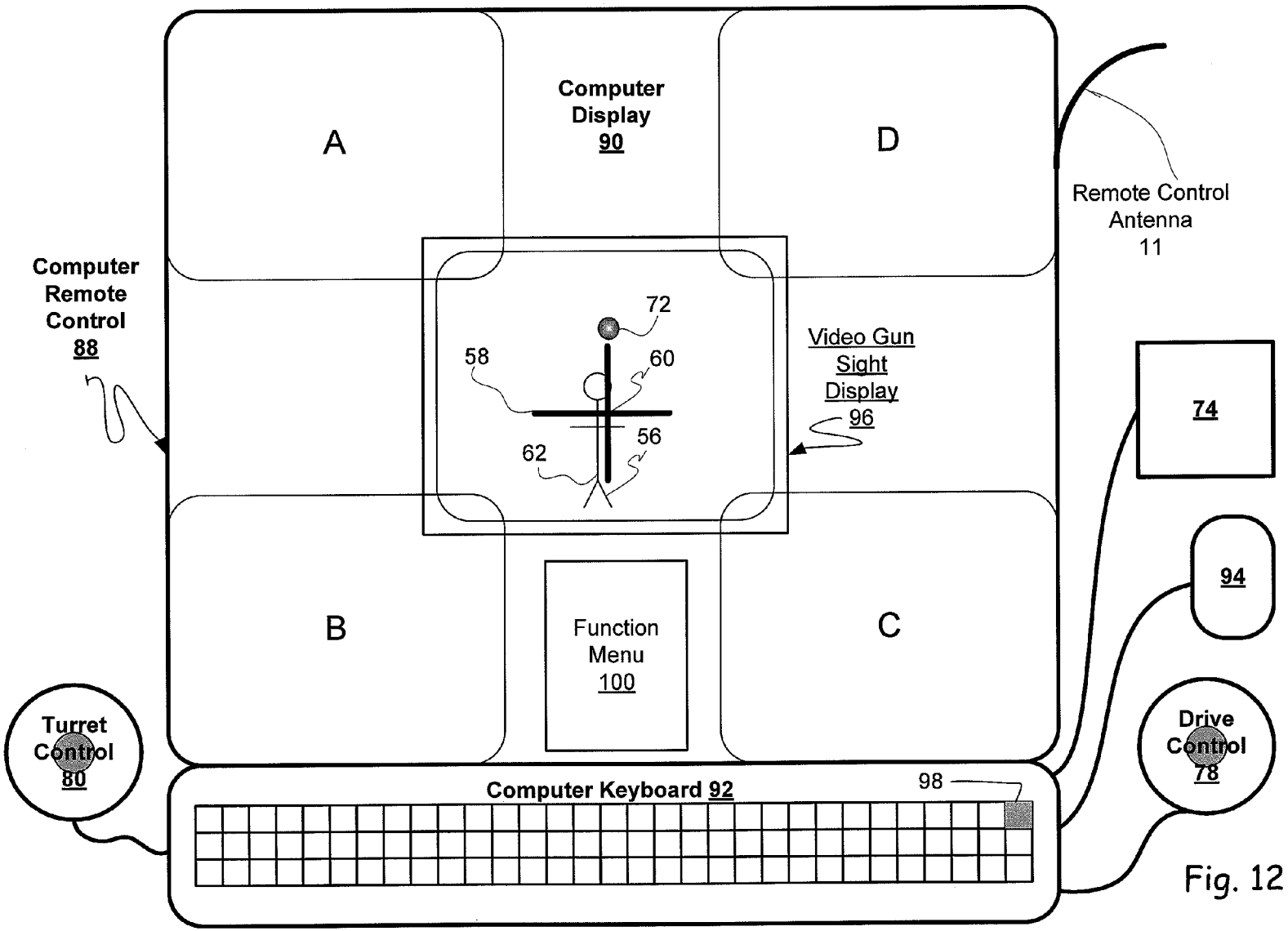
FIG. 12 is representation of computer based remote control as shown in FIG. 11.

Referring now to FIG. 12, the functions of remote control 74 may be provided by a personal computer, digital assistant or handheld electronic game device, such as computer remote control device 88. Computer 88 includes display 90, keyboard 92 which may be a standard or special purpose keyboard, and/or one or more additional computer entry devices such as joysticks 78 and 80 used for example for turret and drive and mouse 94. Computer remote control 88 may be directly connected via an appropriate radio frequency transmitter and remote control antenna 11 to paintball gun 10 or may be connected via a network, such as the Internet, to another computer or device which includes the transmitter and antenna 11.

The video displayed on display 90 may conveniently be divided up into multiple sections, shown for example as sections A, B, C and D, to provide an appropriate portion of the playing field so that the operator has an useful field of view for driving, aiming and firing gun 10. These display sections may be from actual video being taken during game play, typically from different vantage points, from one or more previously taken videos from the game play field or may be a computer generated display. In addition, video gun sight display 96, similar to the display provided on display 54 as shown in FIG. 11, may be positioned and/or superimposed on computer display 88, preferably from the vantage point of gun barrel 22 and at a higher level of magnification than display sections A, B, C and D discussed above.

Joysticks 78 and 80 may be special purpose devices, such as those mounted to remote control 74, or general purpose devices programmed to perform the same functions. Similarly, firing button 98 may be implemented with a special purpose key or a selected keyboard entry function. Mouse 94 may be used in lieu of one or more of the joysticks or in addition thereto to select one or more functions from function menu 100 which may be displayed on display 96. Alternately, remote control 74 may be connected to computer 88 as an accessory to wholly or partly provide the functions of remote control 74 described above with regard to FIG. 11 while computer 88 provides the remaining functions as well as the enhanced display of additional sections of the playing field and/or function menu 100.

In operation, computer remote control 88 with various accessories which may include remote control 74, or a modified version thereof, may be used by an operator from a location remote from the play field, such as a hospital or from the operators home, via a network connection to participate in actual game play with paintball gun 10 with paintball players currently on a playing field, and/or with other remote control operators each with their own paintball gun on an actual or computer generated playing field or as a video game with other remote operators or as an interactive video game without other players or operators.

It is important to note that the play, from the remote operator's standpoint, can be made to feel extremely realistic and consistent with various devices such as remote controls 74 and 88. This interchangeability of the play experience both enhances the game play, provides the opportunity to gain practice and experience in a video game which relates directly to actual game play and permits a player operator to play paintball more often, even if not physically able to play on the field or not able to play for geographic reasons, i.e. while traveling.

Figure 13:
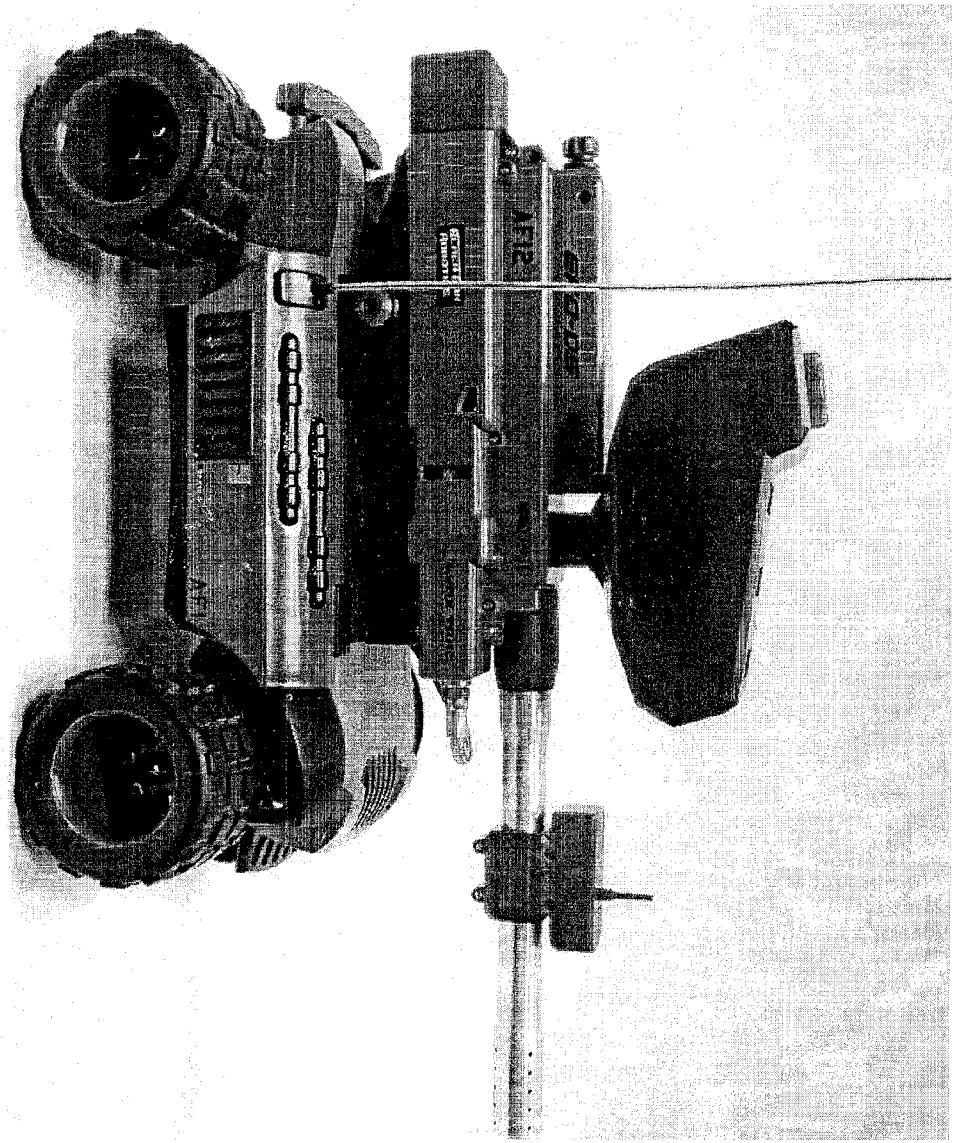
FIGS. 13, 14 and 15 are side, front and top views of a preferred embodiment of the remote control, self propelled paintball gun shown in FIG. 1.
Figure 14:
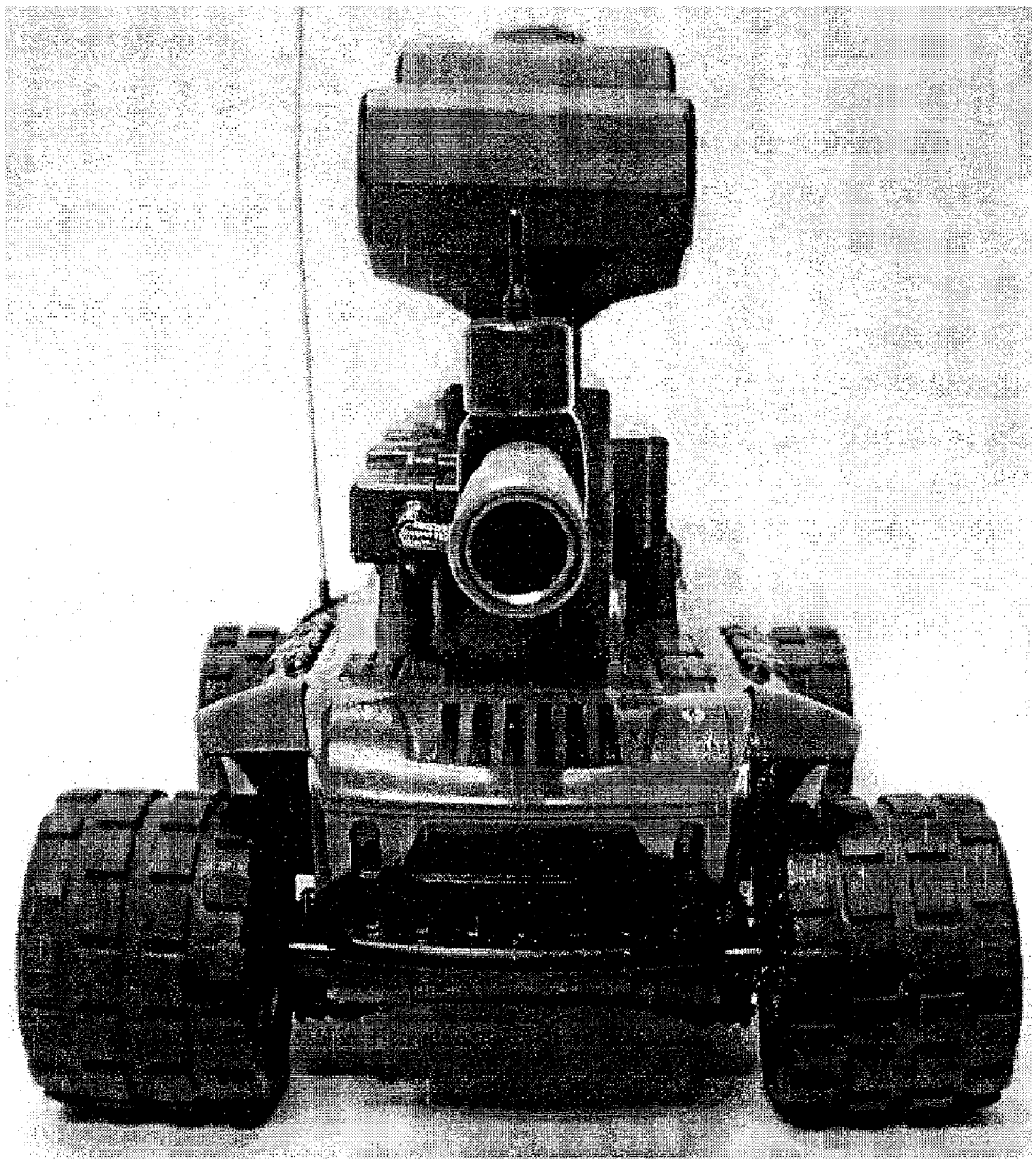
Figure 15:
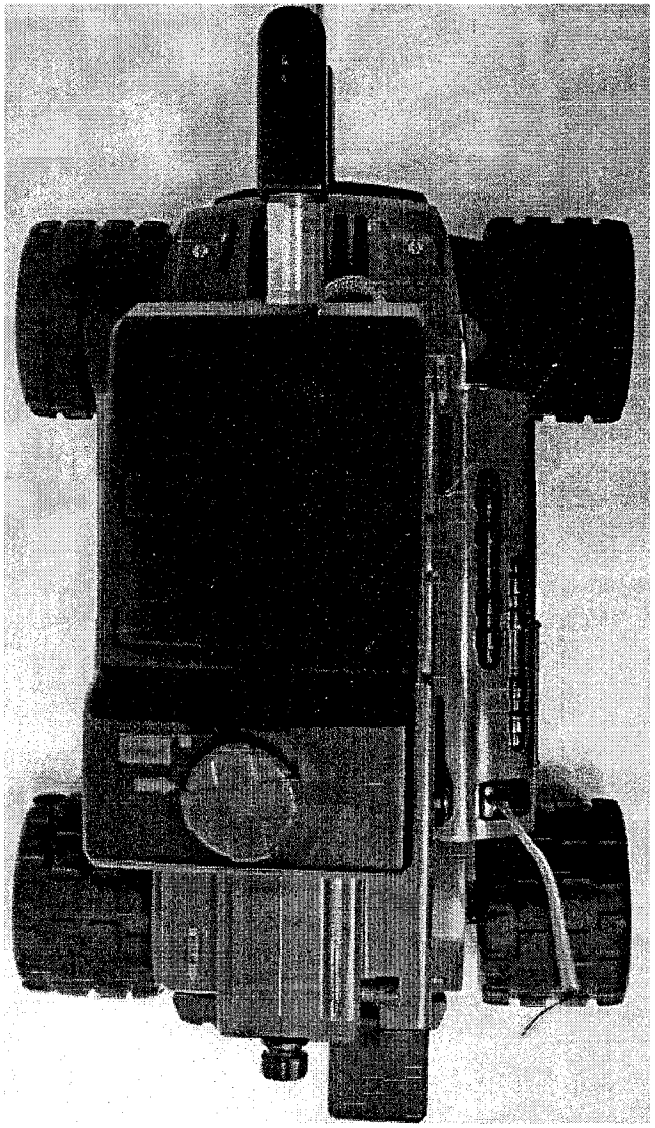

Referring now to FIGS. 13, 14 and 15, side, front and top views of a preferred embodiment of the remote controlled, self propelled paintball gun are shown.

The invention claimed is:

1. A remote control paintball gun system, comprising:

a hopper for containing paintballs, wherein the hopper further comprises:

a first compartment for containing a first plurality of paintballs having a first density; and a second compartment for containing a second plurality of paintballs having a different density;

a paint ball gun barrel associated with the hopper for receiving paintballs;

a motorized, wheeled chassis for supporting the gun barrel and the hopper;

a cartridge mounted along a side of the gun barrel for powering the gun barrel; and a remote control for controlling motion of the chassis, transfer of one of the paint balls from the hopper to the gun barrel, and firing of a paintball from the paintball gun barrel.

2. The invention of claim 1 wherein the remote control further comprises:

a control for selectively transferring a paintball in accordance with the paintballs density, from the first or second plurality of paintballs, to the gun barrel.

3. The invention of claim 2 wherein the remote control controls elevation of the gun barrel.

4. The invention of claim 3 wherein the remote control further comprises:

a user operable range control for selecting a range of fire of the paintball gun, the range control determining both the elevation of the gun barrel and the selection of the paintball to be transferred to the gun barrel from the first or second compartment in accordance with the selected range.

5. The invention of clam 4, further comprising:

a turret supporting the gun barrel, the turret mounted on the chassis for elevation rotation about a first axis and azimuthal rotation about a second axis crossing the first axis at right angles.

6. The invention of claim 1, wherein the remote control further comprises:

a target display calibrated to show an expected point of contact with a target based on the density of the paintball to be fed from the hopper to the gun barrel.

7. The invention of claim 6, wherein the target display further comprises:

a display of expected points of contact with the target for paintballs having different densities.

8. The invention of claim 6, wherein the target display further comprises:

a display indicating an elevation of the gun barrel required to achieve the expected point of contact.

* * * * *